United States Patent [19]

Wood

[11] Patent Number: 4,656,685

[45] Date of Patent: Apr. 14, 1987

[54] DUCT CLEANER

[75] Inventor: H. Larry Wood, Arlington, Tex.

[73] Assignee: Blackmon Mooring Steamatic Catastrophe, Inc., Fort Worth, Tex.

[21] Appl. No.: 746,511

[22] Filed: Jun. 19, 1985

[51] Int. Cl.[4] ..... B08B 9/04

[52] U.S. Cl. ..... 15/104.16; 134/166 C

[58] Field of Search ..... 15/104.16, 104.17, 104.18, 15/104.19, 104.2, 104.3 R; 134/166 C, 167 C, 168 C; 118/73, DIG. 10; 166/312, 322, 323

[56] References Cited

U.S. PATENT DOCUMENTS

| | | | |
|---|---|---|---|
| 1,308,469 | 7/1919 | Amet | 15/104.16 |
| 4,184,220 | 1/1980 | Coyle | 15/104.2 |
| 4,349,073 | 9/1982 | Zublin | 134/167 C |
| 4,441,557 | 4/1984 | Zublin | 134/167 C X |

*Primary Examiner*—Edward L. Roberts
*Attorney, Agent, or Firm*—Arthur F. Zobal

[57] ABSTRACT

The duct cleaner is formed of a nozzle conduit having connecting members at its opposite ends and spray nozzles intermediate its ends, an end conduit having connecting members at its opposite ends, and a plug member having a connecting member at one end and an eye bolt at its other end. The end conduit is adapted to have a sponge or the like fitted around its exterior for engaging the walls of a duct to be cleaned. The end conduit with its sponge is connected to a hose and to one end of the nozzle conduit and the plug member is connected to the other end of the nozzle conduit and to a rope which is used to pull the duct cleaner and hose through the duct with the spray nozzles ahead of the cleaning member while fluid from the hose is sprayed onto the interior walls of the duct by way of the spray nozzles. At the end of the first pass, the position of the spray nozzles and sponge may be reversed and the tool pulled back through the duct by the hose with fluid from the hose sprayed onto the walls of the duct by the nozzles ahead of the sponge.

33 Claims, 6 Drawing Figures

41
43
53
51
49
25
47
29
21
31A
31B
31C
27
27A
35
45
33
57
55
51
49
25
47
29
21
31A
31C
27
35A
35
23
37
39
38
33

DUCT CLEANER

BACKGROUND OF THE INVENTION

1. Field of the Invention

A duct cleaner which is moved through ductwork for cleaning purposes.

2. Description of the Prior Art

A need exists for a tool for efficiently cleaning and sealing the ductwork in homes and building. U.S. Pat. Nos. 1,531,439, 2,601,691, 3,994,310 and 4,071,919 disclose different types of pipe and duct cleaners. These devices, however, are not satisfactory for efficiently cleaning and sealing different sizes of ductwork.

SUMMARY OF THE INVENTION

It is an object of the invention to provide a new and useful apparatus for efficiently cleaning and sealing different sizes of ductwork. This is accomplished by moving the apparatus through the ductwork until the desired process is completed.

The apparatus comprises a nozzle conduit having connecting means at its opposite ends and nozzle means intermediate its ends, an end conduit having connecting means at its opposite ends, and a plug member having connecting means at one end and means at its other and to which a rope or the like may be connected. The end conduit is adapted to have a flexible member fitted around its exterior for engaging the walls of a duct to be processed. The end conduit with its flexible member is connected to a hose and to one end of the nozzle conduit and the plug member is connected to the other end of the nozzle conduit and to a rope which is used to pull the apparatus and hose through the duct with the nozzle means ahead of the flexible member while fluid from the hose is sprayed onto the interior walls of the duct by way of the nozzle means.

The apparatus can be moved back through the duct in the opposite direction by disconnecting the end conduit from the hose and nozzle conduit; removing the flexible member and replacing it if desired; connecting the end conduit and nozzle conduit together again; disconnecting the nozzle conduit from the plug member; turning the end conduit and nozzle conduit around; connecting the nozzle conduit to the hose; and connecting the plug member to the end conduit. The apparatus with the rope attached thereto than may be pulled back through the duct by the hose while fluid from the hose is sprayed onto the interior walls of the duct by way of the nozzle means ahead of the flexible member.

DESCRIPTION OF THE PREFERRED EMBODIMENT

Figures 1, 2, 3:
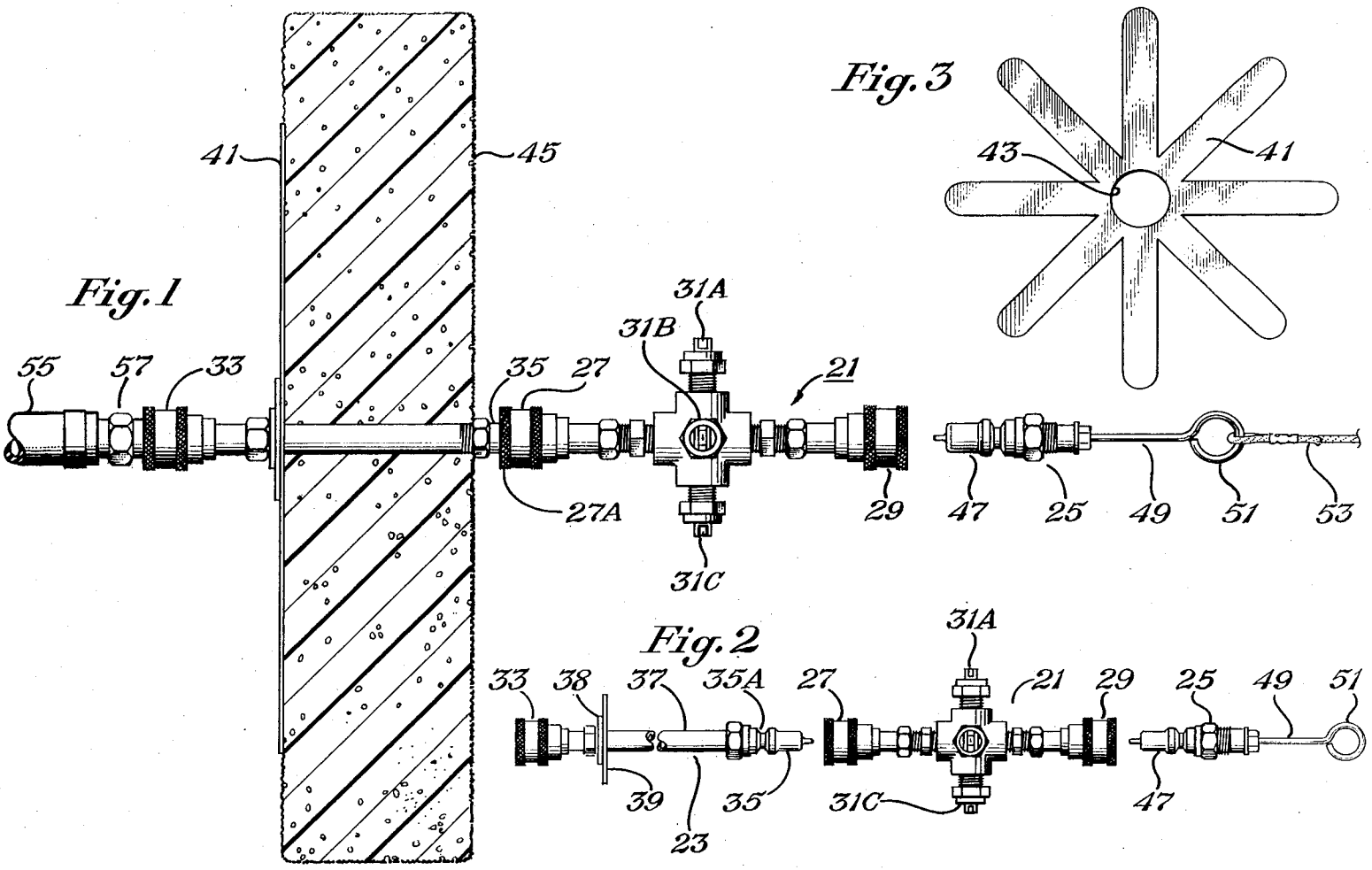
FIG. 1 is a side view of the duct cleaner of the invention assembled to move from left to right.
FIG. 2 is an exploded view of the duct cleaner.
FIG. 3 is a sponge support used with the duct cleaner.

Referring now to the drawings, the duct cleaner is made up of a nozzle conduit or tube 21, an end conduit or tube 23, and a plug member 25. The tube 21 has female, quick-disconnect members 27 and 29 at its opposite ends and four spray nozzles 31A, 31B, 31C, and 31D intermediate its ends. The spary nozzles are in fluid communication with the interior of the tube 21 and are employed for spraying the fluid in the tube 21 radially outward onto the walls of the duct to be cleaned or operated on. Adjacent nozzles are 90 degrees apart.

The end tube 23 has a female quick-disconnect member 33 at one end and a male quick-disconnect member 35 at the other end. It has a cylindrical shaped exterior surface 37 between the members 33 and 35 around which are fitted washers 38, 39, and a thin sponge support member 41 have a central aperture 43. A sponge 45 having a central aperture 47 can be fitted from end member 35 around the surface 37 of end tube 23.

The plug member 25 has a male quick-disconnect member 47 at one end and an eye bolt 49 with a closed loop 51 at the other end. A rope 53 is tied to the loop 51.

Also provided is an elongated flexible hose 55 having a quick-disconnect male member 57 at one end. The other end of the hose 55 is coupled to the outlet 58 of a pump 59 whose inlet is connected to solution tanks 61–64 by way of tube 65 and valves 71–74. In one embodiment, tank 61 contains water, tanks 62 and 63 contain liquid cleaning agents and tank 64 contains a liquid sealant. Member 77 is a pressure adjustment valve and member 79 is a pressure gauge.

The male and female quick-disconnect members shown are commercially available members that can be readily connected to and disconnected from each other. Referring, for example, to members 27 and 35, member 27 comprises a sleeve 27A that is urged axially away from the tube 21 by a spring (not shown). The member 35 can be connected to member 27 by moving the sleeve 27A back axially, inserting the male member 35 within the sleeve 27A and then allowing the sleeve 27A to spring outward axially with an inside component engaging the groove 35A of member 35 and forming a fluid tight connection between members 35 and 27. For disconnection, the sleeve 27A is moved back axially and the male member 35 is removed.

In using the duct cleaner, it is assembled as shown in FIG. 1. A sponge 45 having a shape corresponding to the inside shape of the duct to be cleaned is fitted around the end tube 23. The dimensions of the sponge 45 will be a little greater than the inside dimensions of the duct. The male member 35 of the end tube 23 will be connected to the female member 27 of tube 21. The male member 47 of plug member 25 will be connected to the female member 29 of tube 21 to plug or seal the other end of tube 21.

A section of the duct is prepared for cleaning by providing openings at both ends. The duct may be a conventional heating, ventilation, air-conditioning duct of a house or building, rectangular in cross-section. A "fish tape" or leader is pushed through the duct from one opening to the other. One end of a rope then is pulled through the duct and its other end tied to the loop 51 of the eye bolt 49. The hose 55 then is connected to the end tube 23 by connecting its male member 57 to the female member 33 of the end tube 23. This provides a fluid flow path from the hose 55 to the nozzles 31A, 31B, 31C, and 31D by way of the tubes 23 and 21. The appropriate valves 72, 73 are opened to provide cleaning agent to the hose 55 which is sprayed onto the inside walls of the duct and is then swabbed and wiped by the sponge 45. In one embodiment, the four spray-jet nozzles deliver approximately one quart of liquid per minute. As the apparatus is pulled through the duct, the sponge 45 swabs the duct walls and wipes and moves the liquid sprayed into the duct with the apparatus as it is moved through the duct.

Figure 4:
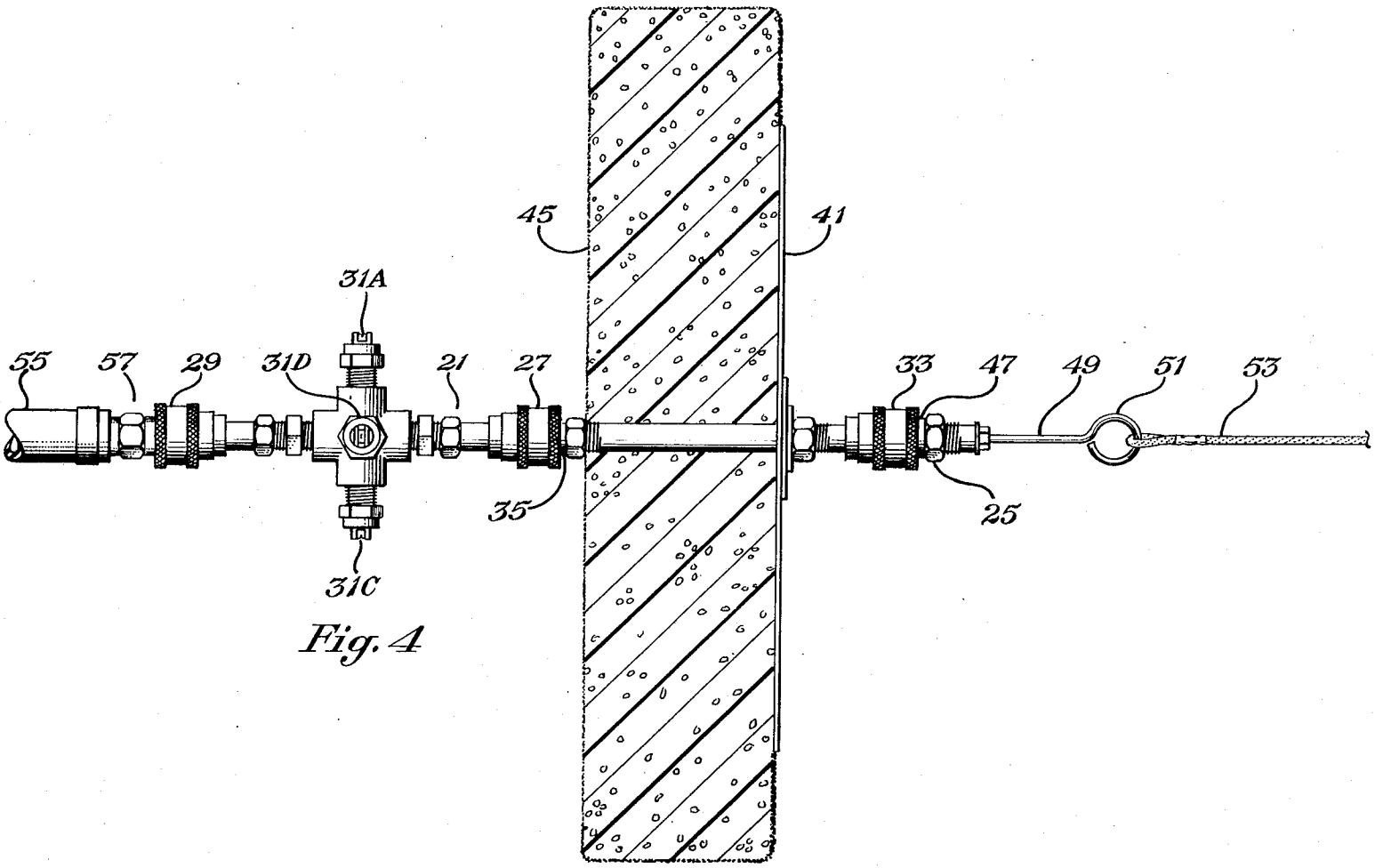
FIG. 4 is a side view of the duct cleaner assembled to move from right to left.
Figure 6:
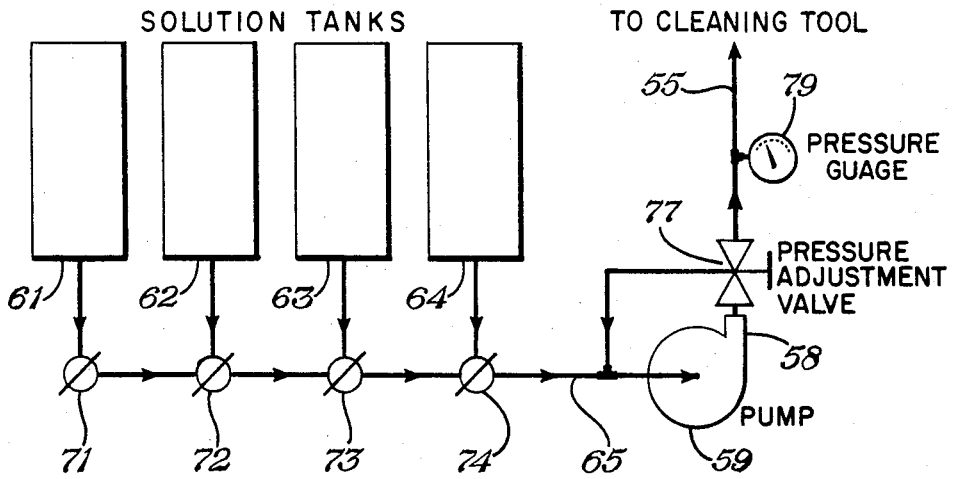
FIG. 6 is a diagram of the solution tanks, pump and other components used in the operation of the duct cleaner.
Figure 5:
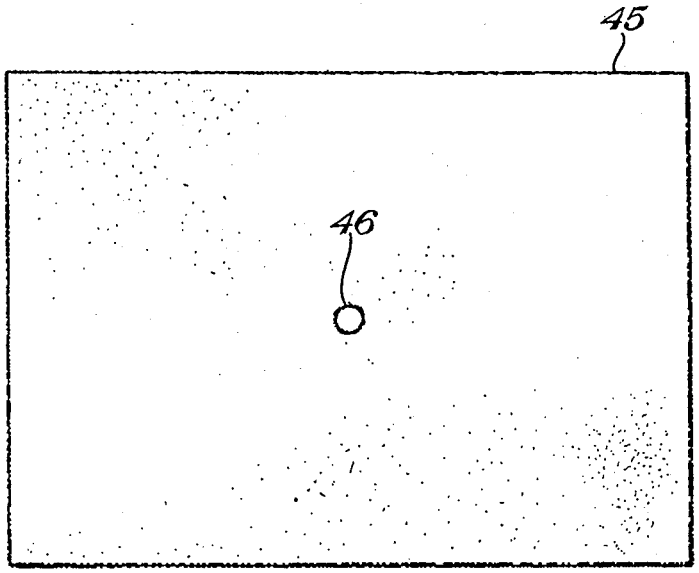
FIG. 5 is an end view of a sponge used with the duct cleaner.

At the end of the first pass, the cleaning agent is shut off, and the sponge is replaced as needed. The position of the spray nozzles and sponge is reversed, as shown in FIG. 4, the cleaning agent solution is sprayed through the nozzles and the tool is pulled back through the duct in an opposite direction by the hose 55, with the rope 53 trailing through the duct as a safety measure in case the hose should pull loose. In the reversal process, members 57 and 33 are disconnected and members 35 and 27 are disconnected. The sponge 45 is removed and replaced if desired. Members 35 and 27 then are reconnected to connect tubes 21 and 23 together and members 29 and 47 are disconnected. Members 29 and 57 then are connected to connect members 21 and 23 to the hose in the reverse direction from the first pass such that the sponge 45 trails the nozzles when the tool is pulled back through by the hose. Prior to pulling the tool back through by the hose, the plug 25 is connected to the end tube 23 by connecting members 33 and 47 together.

The tool is moved back and forth through the duct for cleaning purposes until the cleaning is completed. The tool then can be moved back and forth through the duct with only water from tank 62 sprayed onto the walls for rinse purposes. During the rinse passes the sponge wipes the walls and removes the liquid from the duct. As a final process, a sealing agent from tank 64 is sprayed onto the walls of the duct by the nozzles and swabbed by the sponge 45. This may be accomplished by one or two more passes of the tool through the duct.

The power unit which supplies the cleaning tool with the cleaning and sealing solutions consists of the pump 59 with a variable pressure control valve 77. There are four stainless steel solution tanks 61–64 to facilitate the different cleaning or sealing solutions such as water, 828 solution (cleaning agent), Liqua-Vac (cleaning agent), and Linset (sealing agent). Each tank has a separate valve (71–74) so that the desired solution can easily be directed to the pump. The controls consists of an electrical switch to send power to the pump, the pressure adjustment valve, and the four solution valves. The entire unit is mounted on a heavy duty 24″×42″ cart for ease of transportation. It requires only a single 120 volt, 20 amp. standard power source. Each of the four tanks was designed with a capacity in excess of six gallons, to facilitate the use of 5-gallon containers of solutions.

In one embodiment, the tool, comprising tubes 21 and 23 and the plug member 25 and eye bolt 29 when connected together, has a length of about 15 inches. The inside diameter of each of tubes 21 and 23 is about ¼ of an inch. The distance between the outer edges of nozzles 31A and 31C and between the outer edges of nozzles 31B and 31D is about 3 inches. The sponge 45 has thickness of about 4 inches and sponge support 41 is formed of thin spring steel. Sponges of different sizes and shapes may be used depending on the size and shape of the duct to be cleaned.

I claim:

1. An apparatus for use in a duct, comprising:

a nozzle conduit having first and second opposite ends and nozzle means intermediate its ends for spraying fluid in said nozzle conduit outward onto the interior walls of a duct, said nozzle conduit having connecting means at its first and second ends, an end conduit having first and second opposite ends with connecting means at its opposite ends, said first end of said end conduit being adapted to be removably connected to the end of a hose and said second end of said end conduit being adapted to be removably connected to said first end of said nozzle conduit for providing a passageway for the flow of fluid from said hose to said nozzle conduit, a flexible member fitted around the exterior of said end conduit for engaging the walls of the duct, a plug member having connection means at one end for removable connection at least to said second end of nozzle conduit, said plug member having means at its other end to which a rope or the like may be connected, in using said apparatus, said first end of said end conduit is connected to the end of said hose, said second end of said end conduit is connected to said first end of said nozzle conduit with said flexible member fitted around said end conduit, said one end of said plug member is connected to said second end of said nozzle conduit and the end of a rope or the like is connected to said other end of said plug member such that said apparatus may be located in the duct and said apparatus and the end of said hose pulled therethrough by the rope in a given direction while fluid is flowing from the hose to said nozzle conduit and is sprayed out of said nozzle means onto the interior walls of the duct ahead of said flexible member.

2. The apparatus of claim 1, wherein said flexible member is defined as a first flexible member:

said apparatus comprising a second flexible member, after said apparatus is pulled through the duct in said given direction, said end conduit may be disconnected from the end of said hose and from said first end of said nozzle conduit, said first flexible member removed from said end conduit and said second flexible member fitted around said end conduit, said second end of said end conduit connected to said first end of said nozzle conduit, said one end of said plug member disconnected from said second end of said nozzle conduit, said second end of said nozzle conduit connected to the end of said hose, and said one end of said plug member connected to said first end of said end conduit such that said apparatus may be located in the duct and said apparatus and the end of the rope pulled therethrough by the hose in a direction opposite said given direction while fluid is flowing from the hose to said nozzle conduit and is sprayed out of said nozzle means onto the interior walls of the duct ahead of said second flexible member fitted around said end conduit.

3. The apparatus of claim 1, wherein:

said nozzle means comprises a plurality of nozzles all of which are located in a single plane transverse to the axis of said nozzle conduit such that all of said nozzles of said nozzle conduit are located in said plane.

4. The apparatus of claim 3, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

5. The apparatus of claim 4, comprising:

a thin support member fitted around the exterior of said end conduit for supporting said flexible member, said support member being located next to said flexible member and on the side of said flexible member which faces said first end of said end conduit, the axes of said nozzle conduit and of said end conduit being aligned when said second end of said end conduit is connected to said first end of said nozzle conduit, said support member extending outward to radial positions relative to said axes beyond that of said nozzle means but less than that of said flexible means, said means at said other end of said plug member to which the end of a rope or the like may be connected comprises a loop means.

6. The apparatus of claim 1, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

7. An apparatus for use in a duct of a house or building, comprising:

a nozzle conduit having first and second opposite ends and nozzle means intermediate its ends for spraying liquid in said nozzle conduit outward onto the interior walls of a duct, said nozzle conduit having connecting means at its first and second ends, an end conduit having first and second opposite ends with connecting means at its opposite ends, a plug member having connecting means at one end and attaching means at its other end to which a rope or the like may be connected, a flexible member having a central aperture formed therethrough such that said flexible member may be fitted around the exterior of said end conduit for engaging the walls of the duct, one end of said end conduit and one end of said nozzle conduit being adapted to be removably connected together with the other ends of said end conduit and of said nozzle conduit being adapted to be removably connected to an end of a hose and to said one end of said plug member respectively for providing a passageway for the flow of liquid from the hose to said nozzle conduit and whereby a rope or the like may be connected to said attaching means of said plug member such that said apparatus may be located in a duct and said apparatus and the end of the hose pulled therethrough by the rope in a given direction while liquid is flowing from the hose to said nozzle conduit and is sprayed out of said nozzle means onto the interior walls of the duct ahead of said flexible member when said flexible member is fitted around the exterior of said end conduit.

8. The apparatus of claim 7, wherein:

said nozzle means comprises a plurality of nozzles all of which are located in a single plane transverse to the axis of said nozzle conduit such that all of said nozzles of said nozzle conduit are located in said plane.

9. The apparatus of claim 7, comprising:

a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit.

10. The apparatus of claim 7, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

11. The apparatus of claim 7, wherein:

after said apparatus is pulled through the duct, said one end of said end conduit and said one end of said nozzle conduit are adapted to be removably connected together with the other ends of said end conduit and said nozzle conduit being adapted to be removably connected to said one end of said plug member and to the end of the hose respectively for providing a passageway for the flow of liquid from the hose to said nozzle conduit such that said apparatus may be located in the duct and said apparatus pulled therethrough by the hose in a direction opposite said given direction while liquid is flowing from the hose to said nozzle conduit and is sprayed out of said nozzle means onto the interior walls of the duct ahead of said flexible member when said flexible member is fitted around the exterior of said end conduit.

12. The apparatus of claim 7, wherein:

said nozzle means comprises a plurality of nozzles all of which are located in a single plane transverse to the axis of said nozzle conduit such that all of said nozzles of said nozzle conduit are located in said plane, a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit.

13. The apparatus of claim 7, wherein:

said nozzle means comprises a plurality of nozzles all of which are located in a single plane transverse to the axis of said nozzle conduit such that all of said nozzles of said nozzle conduit are located in said plane, said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

14. The apparatus of claim 7, wherein:

said nozzle means comprises a plurality of nozzles all of which are located in a single plane transverse to the axis of said nozzle conduit such that all of said nozzles of said nozzle conduit are located in said plane, after said apparatus is pulled through the duct, said one end of said end conduit and said one end of said nozzle conduit are adapted to be removably connected together with the other ends of said end conduit and said nozzle conduit being adapted to be removably connected to said one end of said plug member and to the end of the hose respectively for providing a passageway for the flow of liquid from the hose to said nozzle conduit such that said apparatus may be located in the duct and said apparatus pulled therethrough by the hose in a direction opposite said given direction while liquid is flowing from the hose to said nozzle conduit and is sprayed out of said nozzle means onto the interior walls of the duct ahead of said flexible member when said flexible member is fitted around the exterior of said end conduit.

15. The apparatus of claim 7, comprising:

a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit, said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

16. The apparatus of claim 7, comprising:

a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit, after said apparatus is pulled through the duct, said one end of said end conduit and said one end of said nozzle conduit are adapted to be removably connected together with the other ends of said end conduit and said nozzle conduit being adapted to be removably connected to said one end of said plug member and to the end of the hose respectively for providing a passageway for the flow of liquid from the hose to said nozzle conduit such that said apparatus may be located in the duct and said apparatus pulled therethrough by the hose in a direction opposite said given direction while liquid is flowing from the hose to said nozzle conduit and is sprayed out of said nozzle means onto the interior walls of the duct ahead of said flexible member when said flexible member is fitted around the exterior of said end conduit.

17. The apparatus of claim 7, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation, after said apparatus is pulled through the duct, said one end of said end conduit and said one end of said nozzle conduit are adapted to be removably connected together with the other ends of said end conduit and said nozzle conduit being adapted to be removably connected to said one end of said plug member and to the end of the hose respectively for providing a passageway for the flow of liquid from the hose to said nozzle conduit such that said apparatus may be located in the duct and said apparatus pulled therethrough by the hose in a direction opposite said given direction while liquid is flowing from the hose to said nozzle conduit and is sprayed out of said nozzle means onto the interior walls of the duct ahead of said flexible member when said flexible member is fitted around the exterior of said end conduit.

18. The apparatus of claim 7, wherein:

said nozzle means comprises a plurality of nozzles all of which are located in a single plane transverse to the axis of said nozzle conduit such that all of said nozzles of said nozzle conduit are located in said plane, a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit, said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

19. The apparatus of claim 7, wherein:

said nozzle means comprises a plurality of nozzles all of which are located in a single plane transverse to the axis of said nozzle conduit such that all of said nozzles of said nozzle conduit are located in said plane, a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit, after said apparatus is pulled through the duct, said one end of said end conduit and said one end of said nozzle conduit are adapted to be removably connected together with the other ends of said end conduit and said nozzle conduit being adapted to be removably connected to said one end of said plug member and to the end of the hose respectively for providing a passageway for the flow of liquid from the hose to said nozzle conduit such that said apparatus may be located in the duct and said apparatus pulled therethrough by the hose in a direction opposite said given direction while liquid is flowing from the hose to said nozzle conduit and is sprayed out of said nozzle means onto the interior walls of the duct ahead of said flexible member when said flexible member is fitted around the exterior of said end conduit.

20. The apparatus of claim 7, wherein:

said nozzle means comprises a plurality of nozzles all of which are located in a single plane transverse to the axis of said nozzle conduit such that all of said nozzles of said nozzle conduit are located in said plane, a thin support member having a central aperture formed therethrough such that said thin support member may be fitted around the exterior of said end conduit to engage and support said flexible member when said flexible member is fitted around the exterior of said end conduit, the minimum distance between the outer edge of said flexible member and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit, said connecting means at said first and second ends of said nozzle conduit and at said first end of said end conuit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected for each other by movement away from each other for disengagement without rotation, after said apparatus is pulled through the duct, said one end of said end conduit and said one end of said nozzle conduit are adapted to be removably connected together with the other ends of said end conduit and said nozzle conduit being adapted to be removably connected to said one end of said plug member and to the end of the hose respectively for providing a passageway for the flow of liquid from the hose to said nozzle conduit such that said apparatus may be located in the duct and said apparatus pulled therethrough by the hose in a direction opposite said given direction while liquid is flowing from the hose to said nozzle conduit and is sprayed out of said nozzle means onto the interior walls of the duct ahead of said flexible member.

21. The apparatus of claim 20, wherein:

said flexible member has a shape sufficient to engage substantially the entire wall of the interior of the duct at the position of said end conduit.

22. The apparatus of claim 7, wherein:

said flexible member has a shape sufficient to engage substantially the entire wall of the interior of the duct at the position of said end conduit.

23. An apparatus for use in a duct of a house or building, comprising:

a nozzle conduit having first and second opposite ends and nozzle means intermediate its ends for spraying liquid in said nozzle conduit outward onto the interior walls of a duct, said nozzle conduit having connecting means at its first and second ends, an end conduit having first and second opposite ends with connecting means at its opposite ends, a plug member having connecting means at one end, a flexible means having a central aperture formed therethrough such that said flexible means may be fitted around the exterior of said end conduit for engaging the walls of the duct, one end of said end conduit and one end of said nozzle conduit being adapted to be removably connected together with the other ends of said end conduit and of said nozzle conduit being adapted to be removably connected to an end of a hose and to said one end of said plug member respectively or to said one end of said plug member and to the end of the hose respectively for providing a passageway for the flow of liquid from the hose to said nozzle conduit such that said apparatus may be located in a duct and said apparatus moved in either one direction through the duct or in an opposite direction while liquid is flowing from the hose to said nozzle conduit and is sprayed out of said nozzle means onto the interior walls of the duct ahead of said flexible means when said flexible means is fitted around the exterior of said end conduit.

24. The apparatus of claim 23, wherein:

said nozzle means comprises a plurality of nozzles all of which are located in a single plane transverse to the axis of said nozzle conduit such that all of said nozzles of said nozzle conduit are located in said plane.

25. The apparatus of claim 24, comprising:

a thin support member having a central aperture formed therethrough such that said thin support member may be fitted around the exterior of said end conduit to engage and support said flexible means when said flexible member is fitted around the exterior of said end conduit, the minimum distance between the outer edge of said flexible means and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit.

26. The apparatus of claim 25, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

27. The apparatus of claim 24, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

28. The apparatus of claim 23, comprising:

a thin support member having a central aperture formed therethrough such that said thin support member may be fitted around the exterior of said end conduit to engage and support said flexible means when said flexible means is fitted around the exterior of said end conduit, the minimum distance between the outer edge of said flexible means and the center of its central aperture being greater than the maximum distance between the outer edge of said thin support member and the center of its central aperture, the maximum distance between the outer edge of said support member and the center of its central aperture being greater than the maximum distance between the outer edge of said nozzle means and the axis of said nozzle conduit.

29. The apparatus of claim 23, wherein:

said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

30. The apparatus of claim 23, wherein:

said flexible means has a shape conforming generally to the shape of the interior of the duct.

31. The apparatus of claim 30, wherein:

said flexible means is formed of sponge-like material.

32. An apparatus for use in a duct of a house or building, comprising:

a nozzle conduit having first and second opposite ends and nozzle means intermediate its ends for spraying liquid in said nozzle conduit outward onto the interior walls of a duct, said nozzle conduit having connecting means at its first and second ends, an end conduit having first and second opposite ends with connecting means at its opposite ends, said end conduit having a portion for receiving a flexible member to be fitted around its exterior for engaging the walls of the duct, a plug member having connecting means at one end, one end of said end conduit and one end of said nozzle conduit being adapted to be removably connected together with the other ends of said end conduit and of said nozzle conduit being adapted to be removably connected to an end of a hose and to said one end of said plug member respectively or to said one end of said plug member and to the end of the hose respectively for providing a passageway for the flow of liquid from the hose to said nozzle conduit such that said apparatus may be located in a duct and said apparatus moved in either one direction through the duct or in an opposite direction while liquid is flowing from the hose to said nozzle conduit and is sprayed out of said nozzle conduit onto the interior walls of the duct ahead of the flexible member when the flexible member is fitted around the exterior portion of said end conduit, said connecting means at said first and second ends of said nozzle conduit and at said first end of said end conduit are of a first type, said connecting means at said second end of said end conduit and at said one end of said plug member are of a second type, a connecting means of said second type attached to the end of the hose, said first and second types of connecting means being quick connect, quick disconnect types of connecting means which may be connected together by movement toward each other for engagement without rotation and may be disconnected from each other by movement away from each other for disengagement without rotation.

33. The apparatus of claim 32, wherein:

said nozzle means comprises a plurality of nozzles all of which are located in a single plane transverse to the axis of said nozzle conduit such that all of said nozzles of said nozzle conduit are located in said plane.

* * * * *